US007825077B2

(12) United States Patent
Singh et al.

(10) Patent No.: US 7,825,077 B2
(45) Date of Patent: Nov. 2, 2010

(54) COMPOSITION OF LUBRICATING OIL FOR TWO STROKE GASOLINE ENGINE AND PROCESS FOR THE PREPARATION THEREOF

(75) Inventors: Arun Kumar Singh, Uttranchal (IN); Naval Kishore Pandey, Uttranchal (IN); Ashok Kumar Gupta, Uttranchal (IN)

(73) Assignee: Council of Scientific and Industrial Research, New Delhi (IN)

( * ) Notice: Subject to any disclaimer, the term of this patent is extended or adjusted under 35 U.S.C. 154(b) by 1206 days.

(21) Appl. No.: 11/374,249

(22) Filed: Mar. 13, 2006

(65) Prior Publication Data

US 2007/0135318 A1 Jun. 14, 2007

(30) Foreign Application Priority Data

Dec. 9, 2005 (IN) ..... 3335/DEL/05

(51) Int. Cl.

| | |
|---|---|
| ***C10M 169/04*** | (2006.01) |
| ***C10M 159/08*** | (2006.01) |
| ***C10M 105/06*** | (2006.01) |
| ***C10M 133/12*** | (2006.01) |

(52) U.S. Cl. ..... 508/491; 508/110; 508/485; 508/563

(58) Field of Classification Search ..... 508/485, 508/491, 100, 563

See application file for complete search history.

(56) References Cited

U.S. PATENT DOCUMENTS

| | | | | |
|---|---|---|---|---|
| 2,595,557 | A * | 5/1952 | Worth et al. | 508/313 |
| 4,759,860 | A * | 7/1988 | Tanaka et al. | 508/307 |
| 5,171,462 | A * | 12/1992 | DeRosa et al. | 508/281 |
| 5,652,201 | A * | 7/1997 | Papay et al. | 508/228 |
| 6,551,965 | B2 * | 4/2003 | Nagamatsu et al. | 508/192 |
| 7,339,088 | B1 * | 3/2008 | O'Brien et al. | 585/804 |

* cited by examiner

*Primary Examiner*—Glenn Caldarola
*Assistant Examiner*—Jim Goloboy
(74) *Attorney, Agent, or Firm*—Ladas & Parry LLP

(57) ABSTRACT

This invention provides a composition of lubricating oil for two stroke gasoline engine and a process for the preparation thereof. In addition to alkyl benzenes, the composition also contains an antioxidant, an antifoaming agent, a pour point dispersant, a corrosion inhibitor and a detergent-dispersant additive, an extreme pressure additive, a lubrication additives, comprising of the following steps (I) removing of insoluble matter from the base stock, (II) tailoring by vacuum distillation, (III) blending of different alkylates, (IV) removing the oxidized matters by adsorption, (V) addition of performance additives and homogenizing the mixture. The product of this invention has utility as lubricating oil for two stroke gasoline engine in both water-cooled and air-cooled two-cycle gasoline engines producing reduced smoke.

22 Claims, No Drawings

COMPOSITION OF LUBRICATING OIL FOR TWO STROKE GASOLINE ENGINE AND PROCESS FOR THE PREPARATION THEREOF

FIELD OF THE INVENTION

The present invention relates to a composition of lubricating oil for two stroke gasoline engine and process for the preparation thereof. This invention particularly relates to composition of lubricating oil for two stroke gasoline engine that mainly contains alkyl benzenes. In addition to alkyl benzenes, the composition also contains an antioxidant, an extreme pressure additive, an antifoaming agent, a pour point depressant, a corrosion inhibitor and a detergent-dispersant additive, lubricity additives, smoke reducers, according to which it produce lower amounts of observable smoke in the exhaust-emission as a result of combustion in a two-stroke gasoline engine.

BACKGROUND OF THE INVENTION

The two-stroke gasoline engine is a well known power source for outboard motors, snow mobiles, motor boats, motorcycles, scooters, mopeds, gensets and a variety of landscaping equipment, e.g., lawn mowers, chain saws, string trimmers and blowers. The widespread use of two stroke gasoline engines is primarily due to their simple design and lightweight construction, their ability to provide high power output with quick starts at low temperature and their relatively low cost. Two-stroke gasoline engines are operated using a mixture of gasoline and a lubricant in prescribed proportions. Because the fuel contains a gasoline lubricant mixture, large amounts of smoke are generated and emitted in the exhaust. The lubricant must provide satisfactory performance characteristics under severe operating conditions. Lubricants for two-stroke gasoline engines are traditionally composed of a mineral oil or synthetic base fluid, performance additive(s) and a solvent, ordinarily a relatively low boiling petroleum distillate, to enhance gasoline/lubricant miscibility.

The technologies developed to date for reducing exhaust emissions from four-stroke car and truck gasoline engines have not been successfully adapted to two-stroke gasoline engines. Hence, there is growing public concern over the high levels of hydrocarbon emissions from these small gasoline engines, as these hydrocarbons do not readily biodegrade. The mineral hydrocarbon emissions are a consequence of the basic design of the gasoline engine. Specifically, in the power stroke of a typical two-stroke gasoline engine, air, oil and fuel are drawn into the crankcase as the combined charge is compressed in the space above the piston. In the exhaust stroke, the burnt gases are discharged through exhaust ports, and a fresh combustible charge is transferred from the crankcase to the space above the piston. Because the exhaust ports open before and close after transfer of the fresh combustible charge occurs, as much as 18% of the fresh charge will be discharged unburned with the exhaust. Consequently, hydrocarbon emissions far exceed the level of emissions from a comparable four-cycle engine.

Water-cooled outboard motors exhaust directly into the water, giving rise to water pollution, whereas the other devices mentioned above, which are equipped with air-cooled two-stroke gasoline engines, produce emissions that pose a serious air pollution problem. For example, many two-stroke gasoline engines produce up to fifty times the pollution of truck engines per horsepower hour. Visible smoke emissions in the exhaust from two-stroke gasoline engines have also recently come under increased scrutiny and regulation. In addition, smoky emissions from two-cycle gasoline engines are also becoming a problem from an aesthetic standpoint.

The petroleum based lubricating oils are hydrocarbons consisting of naphthenes, paraffins, aromatics, polynuclear aromatics and unsaturates. Various additives, which are primarily chemicals of defined composition or structure, are added to the lube oils to improve the physico-chemical properties and performance.

Petroleum based lube oils, generally suffer from many disadvantages such as high toxicity to the environment, poor biodegradability and inconsistent characteristics with change in crude oil composition. The other types of lubricants known as synthetic lubricants are deigned for use in extreme conditions of temperature, pressure, radiation or chemical and have excellent lubricity and thermal stability. The synthetic lubricants are relatively costly, also toxic to environment and are may not be eco-friendly. Commonly used synthetic lubricants for various applications are, a) Poly-glycols,
b) polybutenes,
c) dibasic acid esters,
d) fluoropolymers,
e) polyol esters,
f) phosphate esters,
g) silicones,
h) poly-alpha olefins,
i) other similar fluids.

The above-noted pollution and smoke problems are exacerbated by the presence of volatile organic solvents in the lubricant. Moreover, some of the solvents used as miscibility enhancers have relatively low flash points, thus creating a potential fire risk, which is of particular concern in connection with the storage and transportation of such products.

In the prior art for producing two-stroke gasoline engine lube oils, generally, mineral oils or mineral oil with synthetic fluids or complex ester of fatty acids were used to enhance the performance. Smoke and eco-friendliness were not the main criteria.

Certain types of monoesters from non-edible vegetable oils are useful to generate reduced amounts of observable smoke as a result of combustion in a two-cycle gasoline engine, can be used on lower concentration and compatible to alkyl benzene.

Reference may be made to U.S. Pat. No. 6,197,731, Zehler, et al., Mar. 6, 2001, Henkel Corporation (Gulph Mills, Pa.) Smokeless two-cycle engine lubricants Ester base stocks for two-cycle gasoline engine lubricant compositions are disclosed which produce lower amounts of observable smoke in the exhaust emitted as a result of combustion in a two-cycle gasoline engine, require no miscibility-enhancing solvents, have a viscosity of 3.0 cst to 20.0 cst at 100.degree. C. and a smoke index of at least 75. Some of the esters are biodegradable. (Here, synthetic esters of polyol type were used).

Reference may be made to U.S. Pat. No. 5,498,353, Lin, et al., Mar. 12, 1996, Chinese Petroleum Corp. (TW) Semi-synthetic two-stroke engine oil formulation. A semi-synthetic two-stroke engine oil formulation which comprises a base oil consisting of a high-viscosity mineral oil, a medium-viscosity mineral oil, a solvent and a mixture of three polyisobutylenes with different molecular weights, and appropriate detergents and dispersants. This semi-synthetic two-stroke engine has both high lubricity and high detergency, and also meets the requirements of low smoke and low exhaust system blocking. (Here, blend of mineral oil and synthetic oil are used)

Reference may be made to U.S. Pat. No. 5,475,171, McMahon, et al., Dec. 12, 1995 BP Chemicals Limited (London, GB2) Two-stroke engine oils. This invention relates to a two-stroke engine oil which comprises polybutene base oils which are either very low in or are substantially free of n-butenes in the polymer backbone. The absence of n-butenes in the polybutenes significantly reduces smoke emission in exhaust gases generated by the use of the engine oil. Polybutenes such as ULTRAVIS® which are substantially free of chlorine and have a high degree of terminal unsaturation are particularly preferred. (Here, blend of mineral oil and synthetic oil are used)

Reference may be made to U.S. Pat. No. 5,378,249, Morrison, Jan. 3, 1995 Pennzoil Products Company (Houston, Tex.) Biodegradable lubricant. A biodegradable two-cycle engine oil composition comprises about (a) 20 to 85 wt. % of a heavy ester or a mixture of heavy ester oils characterized by a kinematic viscosity of at least about 7.0 cst at 100.degree. C., (b) 10 to 85 wt. % of a light ester oil or a mixture of light ester oils characterized by a kinematic viscosity of less than about 6.0 cst at 100.degree. C., and optionally an additive, wherein the composition has a biodegradability of at least about 66% as measured by the CEC L-33-T-82 method. (Here, blend of mineral oil and synthetic oil are used)

Reference may be made to U.S. Pat. No. 6,281,173, Tanaka, et al. Aug. 28, 2001 Castrol Limited (Wiltshire, GB), 'Two-stroke motorcycle lubricant' describes a two-stroke motorcycle lubricant comprising a base oil having a viscosity at 100.degree. C. of less than 8 cst and a pour point below −30.degree. C., preferably below −39.degree. C. The two-stroke motorcycle lubricant further comprises a detergent system based on an ashless, oil-soluble amine. The two-stroke motorcycle lubricant exhibits high levels of cleanliness and low levels of exhaust smoke, whilst maintaining high load carrying capacity. The two-stroke motorcycle lubricant may be dyed. (here mineral oil base stocks were used)

Reference may be made to U.S. Pat. No. 6,573,224, McNeil, et al., Jun. 3, 2003, Bardahl Manufacturing Corporation (Seattle, Wash.) Two-cycle engine lubricant composition comprising an ester copolymer and a diester. Improved performance of two-cycle and four-cycle engines is achieved by adding to the oil or fuel of such engines a composition that contains a copolymer of an alpha-olefin and a dialkyl fumarate or maleate and/or a synthetic diester compound that has about 30 carbon atoms. For two-cycle engines, the composition preferably contains both chemicals, in addition to an octane booster such as methylcyclopentadienyl manganese tricarbonyl. For four-cycle engines, the composition contains at least one of the copolymer and diester, in addition to a molybdenum or bismuth salt, dimercapto 1,3,4-thiadiazole and sulfur-phosphorous EP and/or chlorinated paraffin. The composition can also act to improve gear and grease lubrication and provide improved lubricity to fuels. (Here, synthetic oil are used)

In view of the growing concern about the environment and conservation of petroleum there is a need for eco-friendly lubricating oil for two-stroke gasoline engine, which are derived from alternate sources without a diluent and reduce smoke, perform better or at least at par with the mineral lube oil and be cost effective.

A patent filled by the inventors of the present invention disclosed the use of Heavy Alkyl Benzene alkaline earth metal sulfonates used as detergent-dispersant-anti rust additive in various types of lubricants (Patent application IPA number 1306/DEL/1998 & 1307/DEL/1998 by A. K. Singh et al assigned to CSIR). The alkyl benzenes are mono, di and poly substituted alkyl aromatics having one benzene or toluene aromatic ring and straight or branched paraffinic chains, preferably mono and di alkyl benzene. Alkyl benzenes are produced, as by-products during the preparation of, (1) linear alkyl benzene (LAB) in detergent industry, (2) heavy aromatic produced in catalytic reformer, and (3) naphtha or gas steam cracker liquid product. Alkyl benzene consists of substituted benzenes and no poly-aromatics/condensed ring or olefinic compounds are present in the alkyl benzenes. It can be used as an alternate to mineral base stock of lubricants. It will reduce the hazard potential of the lubricants. It will provide required properties such as good lubricating oil for two stroke gasoline engine properties, lubricity, load carrying, stability, anti-corrosion properties and more eco-friendliness.

OBJECTIVES OF THE INVENTION

The main object of the present invention is to provide a composition of lubricating oil for two stroke gasoline engines and process for the preparation thereof which obviates the drawbacks as detailed above.

Another object of the present invention is to provide a composition of lubricating oil for two stroke gasoline engine and process for the preparation thereof from alternate source based on alkyl benzenes obtained from various petrochemical or refinery waste streams such as heavy alkylates from LAB plants, higher aromatic from catalytic reformers or steam cracking plants.

Yet another object of the present invention is to avoid the use of polynuclear aromatic hydrocarbons, a component of mineral oil and reducing pollution potential of the lubricating oil for two stroke gasoline engine formulation.

Still another object of the present invention is to provide excellent miscibility of formulated lubricating oil for two stroke gasoline engine with mineral, vegetable and synthetic oil in all proportions.

SUMMARY OF THE INVENTION

Accordingly the present invention provides a composition of lubricating oil for two stroke gasoline engine comprising (i) base stoke of tailored heavy alkyl benzene having carbon atom mainly C21 to C25 in the range of 80-90 wt %,
(ii) anti-oxidant in the range of 0.006-0.05% by weight
(iii) extreme pressure additive in the range of 0.01-0.05% by weight,
(iv) detergent-dispersant in the range of 0.05-0.15% by weight,
(v) anti-foaming agent in the range of 0.01 to 1.0% by weight,
(vi) pour point dispersant in the range of 0.01 to 1.0% by weight,
(vii) corrosion inhibitor in the range of 0.10-0.03% by weight
(viii) smoke reducing agent in the range 9.0-19.0% by weight and
(ix) optionally with lubricity additive in the range of 0.01-0.05% by weight.

In an embodiment of the present invention the composition of lubricating oil has following characteristics:

(i) Kinetic viscosity at 40° C. is in the range of 40-60 cst,
(ii) Kinetic viscosity at 100° C. is 6.5-8.5 cst,
(iii) Viscosity index 95-110,
(iv) Oxidation stability Pass (IP 48/97)
(v) Rotatory bomb oxidation test (ROBOT) at 95° C. is 250-350 min.,
(vi) Flash point 145-165° C.,
(vii) Pour point (−)20-30° C.,
(viii) Ash sulfated <0.05, (ix) Performance-Smoke index 150-250, (x) Lubricity-Friction.Coeff. about 0.101, (xi) Wear Scarp Dia (WSD) about 0.533, (xii) Detergency index 200-250, (xiii) Copper Strip corrosion test 1A, (xiv) Foam test ASTM D130 Pass, (xv) Biodegradability 40-60%.

In yet another embodiment the heavy alkyl benzene used is mono, di and poly substituted alkyl aromatics having one benzene aromatic ring and straight or branched paraffinic chains having carbon atoms 21 to 25.

In yet another embodiment the heavy alkyl benzene fractions (C21-25) used is obtained from mono and di alkyl benzenes produced during the production of linear alkyl benzene (LAB) in detergent industry, heavy alkyl aromatics produced in catalytic reformer, and naphtha or gas steam cracker liquid product or mixture thereof.

A composition as claimed in claim 1, wherein the anti-oxidant used is selected from the group consisting of 2,4,6-tri-tert-butylphenol, 2,6-di-tert-butyl-4-n-butylphenol, 2,6-di-t-butyl-4-methylphenol or n-octadecyl 3-(3,5-di-t-butyl-4-hydroxy phenyl) propionate, penta erythrityl tetrakis[3-(3,5-di-t-butyl-4-hydroxyphenyl) propionate], di-n-octadecyl (3,5-di-t-butyl-4-hydroxybenzyl)phosphonate, 2,4,6-tris(3,5-di-t-butyl-4-hydroxybenzyl) mesitylene, tris(3,5-di-t-butyl-4-hydroxybenzyl) isocyanurate or hindered piperidine carboxylic acids, acylated derivatives of 2,6-dihydroxy-9-azabicyclo[3.3.1]nonane or bicyclic hindered amines or diphenylamines or dinaphthylamines, phenylnaphthyl amines, N,N'-diphenylphenylenediamine or p-octyldiphenylamine, p,p-dioctyl diphenylamine, N-phenyl-1-naphthylamine, N-phenyl-2-naphthylamine, N-(p-dodecyl)phenyl-2-naphthylamine, di-1-naphthylamine, di-2naphthylamine, N-alkyl phenothiazines, imino(bisbenzyl), 6-(t-butyl)phenol, 2,6-di-(t-butyl)phenol, 4-methyl-2,6-di-(t-butyl) phenol, 4,4'-methylenebis(-2,6-di-(t-butyl)phenol), Methyl etramer hydro cinnamide, phenothiazines derivatives, alkylated 5-amino tetrazole, di-ter.Butyl p-amino phenol and a mixture thereof.

In yet another embodiment the extreme pressure additive used is selected from the group consisting of sulfurized neem oil, sulfurized mahua oil, dibenzyl disulphide, suphurized pentadecyl phenol, thiophosphoro luryl oleate, molybdenum salt of thiophosphoro luryl oleate, zinc dialkyl dithio phosphate, dibenzyl diselenate, selenophosphoro luryl oleate, selenophosphoro pentadecyl phenol, molybdenum thiophosphoro pentadecyl phenol and a mixture thereof.

In yet another embodiment the lubricity additive used is selected from octyl phosphates, methyl etramer hydro cinnamide and a mixture thereof.

A composition as claimed in claim 1, wherein the detergent-dispersant used is selected from the group consisting of calcium alkyl benzene sulfonate, sodium alkyl benzene sulfonate, propylene etramer succinimide of pentaethylene hexamine, octyl phosphonates and a mixture thereof.

In yet another embodiment the anti-foaming agent used is selected from the group consisting of silicone oil, polyvinyl alcohol, polyethers and a mixture thereof.

A composition as claimed in claim 1, wherein the pour point dispersant used is selected from the group consisting of diethylhexyl adipate, polymethacrylate, polyvinylacrylate and a mixture thereof.

In yet another embodiment the corrosion inhibitor used is selected from the group consisting of octyl 1H benzotriazole, ditertiary butylated 1H-Benzotriazole, propyl gallate, polyoxyalkylene-polyols, octadecyl amines, nonyl phenol ethoxylates, calcium phenolates of hydrogenated pentadecyl phenol, magnesium alkyl benzene sulfonates and a mixture thereof.

In yet another embodiment the smoke reducing agent used is selected from the group consisting of neem oil, mahua oil, ricebran oil, acetylated castor oil, linseed oil, karanja oil, ethyl hexyl ester of neem oil fatty acid, ethyl hexyl ester of karanja oil fatty acid, ethyl hexyl ester of neem oil fatty acid, toluene derivative of vegetable oil/its mono-esters and a mixture thereof.

The present invention further provides a process for the preparation of composition for lubricating oil for two stroke gasoline engine, which comprises fractionating heavy alkylate fractions of linear alkyl benzene (LAB) or crackers, at a temperature in the range of 350-550° C., under vacuum distillation to obtain desired fractions of alkyl benzene having carbon atom C21 to C25 and viscosity in the range of 6-8 cst at about 100° C., removing the oxidized product from the above alkyl fractions by known methods to obtain a base stock, mixing 80-90 wt % of the above said base stock, at least one anti-oxidant in the range of 0.006-0.05 W %, at least one extreme pressure additive in the range of 0.01-0.05 W %, at least one detergent-dispersant in the range of 0.05-0.15 W %, at least one anti-foaming agent in the range of 0.01 to 1.0 W %, at least one pour point dispersant in the range of 0.01 to 1.0 W %, at least one corrosion inhibitor in the range of 0.10-0.03 W %, at least one smoke reducing agent in the range 9.0-19.0 W %, and optionally at least one lubricity additive in the range of 0.01-0.05 W %, under stirring, at a temperature in the range of 50-90° C. to obtain the desired lubricating oil composition.

In yet another embodiment the heavy alkyl benzene used is mono, di and poly substituted alkyl aromatics having one benzene aromatic ring and straight or branched paraffinic chains having carbon atoms mainly C21 to C25

In yet another embodiment the heavy alkyl benzene fractions (C21-25) used is obtained from mono and di alkyl benzenes produced during the production of linear alkyl benzene (LAB) in detergent industry, heavy alkyl aromatics produced in catalytic reformer, and naphtha or gas steam cracker liquid product or mixture thereof.

In yet another embodiment the anti-oxidant used is selected from the group consisting of 2,4,6-tri-tert-butylphenol, 2,6-di-tert-butyl-4-n-butylphenol, 2,6-di-t-butyl-4-methylphenol or n-octadecyl 3-(3,5-di-t-butyl-4-hydroxy phenyl) propionate, penta erythrityl tetrakis[3-(3,5-di-t-butyl-4-hydroxyphenyl)propionate], di-n-octadecyl (3,5-di-t-butyl-4-hydroxybenzyl) phosphonate, 2,4,6-tris(3,5-di-t-butyl-4-hydroxybenzyl) mesitylene, tris(3,5-di-t-butyl-4-hydroxybenzyl) isocyanurate or hindered piperidine carboxylic acids, acylated derivatives of 2,6-dihydroxy-9-azabicyclo[3.3.1]nonane or bicyclic hindered amines or diphenylamines or dinaphthylamines, phenylnaphthyl amines, N,N'-diphenylphenylenediamine or p-octyldiphenylamine, p,p-dioctyl diphenylamine, N-phenyl-1-naphthylamine, N-phenyl-2-naphthylamine, N-(-dodecyl)phenyl-2-naphthylamine, di-1-naphthylamine, di-2naphthylamine, N-alkyl phenothiazines, imino(bisbenzyl), 6-(t-butyl)phenol, 2,6-di-(t-butyl)phenol, 4-methyl-2,6-di-(t-butyl) phenol, 4,4'-methylenebis(-2,6-di-(t-butyl)phenol), Methyl etramer hydro cinnamide, phenothiazines derivatives, alkylated 5-amino tetrazole, di-ter.Butyl p-amino phenol and a mixture thereof.

In yet another embodiment the extreme pressure additive used is selected from the group consisting of sulfurized neem oil, sulfurized mahua oil, dibenzyl disulphide, suphurized pentadecyl phenol, thiophosphoro luryl oleate, molybdenum salt of thiophosphoro luryl oleate, zinc dialkyl dithio phosphate, dibenzyl diselenate, selenophosphoro luryl oleate, selenophosphoro pentadecyl phenol, molybdenum thiophosphoro pentadecyl phenol and a mixture thereof.

In yet another embodiment the lubricity additive used is selected from octyl phosphates, methyl etramer hydro cinnamide and a mixture thereof.

A process as claimed in claim 13, wherein the detergent-dispersant used is selected from the group consisting of calcium alkyl benzene sulfonate, sodium alkyl benzene sulfonate, propylene etramer succinimide of pentaethylene hexamine, octyl phosphonates and a mixture thereof.

In yet another embodiment the anti-foaming agent used is selected from the group consisting of silicone oil, polyvinyl alcohol, polyethers and a mixture thereof.

In yet another embodiment the pour point dispersant used is selected from the group consisting of diethylhexyl adipate, polymethacrylate, polyvinylacrylate and a mixture thereof.

In yet another embodiment the corrosion inhibitor used is selected from the group consisting of octyl 1H benzotriazole, ditertiary butylated 1H-Benzotriazole, propyl gallate, polyoxyalkylene polyols, octadecyl amines, nonyl phenol ethoxylates, calcium phenolates of hydrogenated pentadecyl phenol, magnesium alkyl benzene sulfonates and a mixture thereof.

In yet another embodiment the smoke reducing agent used is selected from the group consisting of neem oil, mahua oil, ricebran oil, acetylated castor oil, linseed oil, karanja oil, ethyl hexyl ester of neem oil fatty acid, ethyl hexyl ester of karanja oil fatty acid, ethyl hexyl ester of neem oil fatty acid, toluene derivative of vegetable oil/its mono-esters and a mixture thereof.

In yet another embodiment the lubricating oil composition obtained has the following characteristics:

(i) Kinetic viscosity at 40° C. is in the range of 40-60 cst,
(ii) ii) Kinetic viscosity at 100° C. is 6.5-8.5 cst,
(iii) Viscosity index 95-110,
(iv) Oxidation stability Pass (IP 48/97)
(v) Rotatory bomb oxidation test (ROBOT) at 95° C. is 250-350 min.,
(vi) Flash point 145-165° C.,
(vii) Pour point (−)20-30° C.,
(viii) Ash sulfated <0.05,
(ix) Performance-Smoke index 150-250,
(x) Lubricity-Friction.Coeff. about 0.101,
(xi) Wear Scarp Dia (WSD) about 0.533,
(xiii) Copper Strip corrosion test 1A,
(xiv) Foam test ASTM D130 Pass,
(xv) Biodegradability 40-60%.

Comparison of Properties of 2T Oil

| SN. | Properties | U.S. Pat. No. 5475171 mineral | U.S. Pat. No. 6197731 synthetic | Our claim Alkylates | Remarks |
|---|---|---|---|---|---|
| 1. | Physico-chemical properties | Pass | Pass | Pass | |
| 2 | Performance tests | Pass | Pass | Pass | |
| 3 | Smoke Index | 95-99 | 75 | 200 | Better |
| 4 | Biodegradability % | 20-40 | 20-40 | 45-55 | Better |
| 5 | Polynuclear Aromatics presence | yes | no | No | Better |

The composition produce observable smoke in the range of 100 to 300 smoke index, require no miscibility-enhancing solvents, needs lower concentrations such as fuel-lube ratio 100:0.2 to 100:2, are significantly non-toxic having no polynuclear aromatic, biodegradable in the range of 35 to 60%, Flash point 130 to 160° C., pour point less than (−)10° C., Kinematic viscosity at 100° C. 2 to 10 cst and able to replace the traditional mineral lube oils. The lubricant compositions of the present invention would be particularly suited for operating air-cooled and water-cooled two stroke gasoline engine. The main advantages are, it reduces use of petroleum, offer better use of petrochemical waste product, cheaper than synthetic oil, reduce green house gases & emissions, having higher smoke index, product is more biodegradable and ecofriendly than petroleum lubes.

The following examples are given by the way of illustration and should not be construed to limit the scope of the invention.

EXAMPLE 1

TAILORING OF HEAVY ALKYLATE: commercial heavy alkylates, a heavy waste fraction of detergent class linear alkyl benzene (LAB), was fractionated by vacuum distillation. The heavier cut having 40 weight percent of total alkylate was taken for base-stock preparation. The typical properties of the alkylate are:

| | |
|---|---|
| Density at 15° C., gm/ml | 0.8809 |
| Kinetic viscosity at 40° C., cst | 54.73 |
| Viscosity index | 100 |
| Refractive index at 20° C. | 1.49026 |
| Pour point | (−)37° C. |
| Molecular weight | 443 ± 5 |
| Distillation range | 415 to 517° C. |
| Poly-aromatics or olefinic compounds | Negligible |

EXAMPLE 2

TAILORING OF ALKYLATE: commercial alkylates, a waste alkyl benzene from cracker unit, was fractionated by vacuum distillation. The heavier cut having 50 weight percent of total alkylate was taken for base-stock preparation. The typical properties of the alkylate are

| | |
|---|---|
| Density at 15° C., gm/ml | 0.8806 |
| Kinetic viscosity at 40° C., cst | 50.11 |

-continued

| | |
|---|---|
| Viscosity index | 105 |
| Refractive index at 20° C. | 1.49106 |
| Pour point | (−)32° C. |
| Molecular weight | 428 ± 5 |
| Distillation range | 400 to 497° C. |
| Poly-aromatics or olefinic compounds | Negligible |

EXAMPLE 3

Preparation of Base Stock

Tailored heavy alkylate was passed through silica gel column to remove oxidized product or treated with absorbent clay such as fuller's earth by mixing and thoroughly stirred for 50 minutes at 80° C. and filtering it through G-4 sintered glass funnel. The typical physico-chemical characteristics of the heavy alkylate are:

| | |
|---|---|
| Kinetic viscosity at 100° C., cst | 7.33 |
| Kinetic viscosity at 40° C., cst | 55 |
| Viscosity index | 103 |
| Oxidation Stability, IP 48/97 | Pass - increase in viscosity 0.9% |
| Pour point | (−)23° C. |
| RoBOT test 95° C. | 350 minutes |
| Flash point | 158° C. |
| Acid number, mg KOH | 0.005 |
| Poly-aromatics or olefinic compounds | Negligible |

EXAMPLE 4

Preparation of Base Stock

Tailored alkylate from cracker unit was passed through silica gel column to remove oxidized product or treated with absorbent clay such as fuller's earth by mixing and thoroughly stirred for 50 minutes at 80° C. and filtering it through G-4 sintered glass funnel. The typical physico-chemical characteristics of the base oil is:

| | |
|---|---|
| Kinetic viscosity at 100° C., cst | 7.0 |
| Kinetic viscosity at 40° C., cst | 52 |
| Viscosity index | 100 |
| Oxidation Stability, IP 48/97 | Pass - increase in viscosity 0.78% |
| Pour point | (−)28° C. |
| RoBOT test 95° C. | 310 minutes |
| Flash point | 155° C. |
| Acid number, mg KOH | 0.005 |
| Poly-aromatics or olefinic compounds | Negligible |

EXAMPLE 5

Preparation of Base Stock

Tailored alkylate from cracker unit and LAB plant were passed through silica gel column to remove oxidized product. 50 wt % of heavy alkylate and 50 wt % of alkylate from cracker unit were mixed and thoroughly stirred for 50 minutes at 60° C. The typical physico-chemical characteristics of the blended base oil is:

| | |
|---|---|
| Kinetic viscosity at 100° C., cst | 7.2 |
| Kinetic viscosity at 40° C., cst | 53 |

-continued

| | |
|---|---|
| Viscosity index | 101 |
| Oxidation Stability, IP 48/97 | Pass - increase in viscosity 0.9% |
| Pour point | (−)25° C. |
| RoBOT test 95° C. | 320 minutes |
| Flash point | 156° C. |
| Acid number, mg KOH | 0.005 |
| Poly-aromatics or olefinic compounds | Negligible |

EXAMPLE 6

Preparation of Lube Oil Base Stock

The base stock was blended with additive octyl 5amino tetrazole as a high temperature anti-oxidant in 200 ppm, dibezyl disulphide as EP additive in 200 ppm, sulfurized neem oil as lubricity additives in 200 ppm, Methyl Hydroxy Hydro Cinnamate as low temperature antioxidant-lubricity additives in 80 ppm, pentaethylene hexamine dodecyl succinimide as detergent-dispersant in 100 ppm, Silicone polymer oil as antifoaming agent-pour point depressant and calcium HAB sulfonate as corrosion inhibitors having base number 500 in 150 ppm concentration and the Toluene substituted ethylhexyl ester of fatty acid of rice bran oil as a smoke reducer and lubricity enhancer in 10% of base oil. The doping was done at 60° C. with stirring for 2 hours.

EXAMPLE 7

Preparation of Lube Oil from Base Stock

The base stock was blended with additive p-p-dioctyl diphenyl amine as a high temperature anti-oxidant in 100 ppm, dibezyl diselenide as EP additive in 200 ppm, sulfurized ricebran oil as lubricity additives in 200 ppm, zinc dialkyl dithio phosphate as low temperature antioxidant-lubricity additives in 50 ppm, octyl phosphonate as detergent-dispersant in 100 ppm, poly vinyl acrylate as antifoaming agent-pour point depressant and alkyl benzotriazole as corrosion inhibitors having base number 500 in 50 ppm concentration and the Toluene substituted ethylhexyl ester of hydrogenated fatty acid of neem oil as a smoke reducer and lubricity enhancer in 10% of base oil. The doping was done at 60° C. with stirring for 2 hours.

EXAMPLE 8

Preparation of Lube Oil from Base Stock

The base stock was blended with additive di-t-butyl 4-methyl phenol as a high temperature anti-oxidant in 100 ppm, Molybdenul thiophosphoro pentadecyl phenol as EP additive in 200 ppm, sulfurized hydrogenated karanja oil as co-EP additives in 200 ppm, Methyl Hydroxy Hydro Cinnamate as low temperature antioxidant-lubricity additives in 150 ppm, pentaethylene hexamine propylene tetramer succinimide as detergent-dispersant in 100 ppm, polymethacrylate as antifoaming agent-pour point depressant and octyl phosphonate as corrosion inhibitors in 150 ppm concentration and the Toluene substituted ethylhexyl ester of fatty acid of karanja oil as a smoke reducer and lubricity enhancer in 10% of base oil. The doping was done at 60° C. with stirring for 2 hours.

EXAMPLE 9

Preparation of Lube Oil from Base Stock

The base stock was blended with additive n-naphthyl 2-phenylamine as a high temperature anti-oxidant in 200 ppm, molybdenum thiophosphoro luryl oleate as EP additive in 200 ppm, dibenzyl diselenide as EP-lubricity additives in 200 ppm, zinc dialkyl dithiophosphate as low temperature antioxidant-lubricity additives in 250 ppm, pentaethylene hexamine propylene tetramer succinimide as detergent-dispersant in 200 ppm, Silicone polymer oil as antifoaming agent-pour point depressant and alkyl 1H benzotriazole as corrosion inhibitors in 150 ppm concentration and the Toluene substituted ethylhexyl ester of fatty acid of mahua oil as a smoke reducer and lubricity enhancer in 10% of base oil. The doping was done at 60° C. with stirring for 2 hours.

EXAMPLE 10

CHARACTERIZATION AND EVALUATION OF LUBE OIL: The formulations were analyzed and evaluated as per ASTM or BIS methods such as ASTM D445/BIS-14234, P25/56—K.Viscosity & Viscosity index, ASTM D 92/BIS-P21/69—Flash point, ASTM D1217/BIS-P16—Rel.Density, ASTM D130/BIS-P15—Copper corrosion, ASTM D97/BIS-P10—Pour point, ASTM D874/BIS-P4—Ash sulphated, ASTM D 664/BIS-P1—TAN, ASTM D4377/BIS-P40—Water, IP 280, 306, 307-Oxidation Test, ASTM D3711—Cocking test, ASTM D4857, 4858, 4859, 4863—Two cycle oil engine test for lubricity-smoke-detergency-varrish-ignition, ASTM D5533—varnish, ASTM D 2157—smoke. The typical values are K.Vis at 40° C. 55 cst, K.Vis at 100° C. 7.5 cst, Viscosity index 104, Oxidation stability Pass (IP 48/97—Oxidation characteristics of lube oil-Max—1% increase in Viscosity and carbon residue for a good stable oil. RoBOT at 95° C.-300 min.), Flash point 158° C., Pour point (−)25° C. and Ash sulfated <0.05, Performance-Smoke index 200, Lubricity, Friction.Coeff 0.101, WSD 0.533, Detergency index 201, Varnish, Starting, Pick up, power, test Pass, Copper Strip corrosion test 1A, Foam test ASTM D130 Pass, Biodegradability 50±5%, Panel cocking test Pass, (Pass means meting the specification as per value of BIS 14234 of 2T oil.)

The Main Advantages of the Present Invention Are:

a) The lubricant would be particularly suited for operating outboard motors, snow mobiles, motor boats, motorcycles, scooters, mopeds, gensets and a variety of landscaping equipment, e.g., lawn mowers, chain saws, string trimmers and blowers, etc.
b) It reduces use of petroleum, offer better use of petrochemical waste product,
c) Reduce green house gases & emissions, having higher smoke index 150 to 250,
d) Product is more biodegradable around 40 to 60% and ecofriendly than petroleum lubes.
e) Reduce visible smoke and provides better or equivalent performance as mineral oil based lubricating oil for two stroke gasoline engines.

We claim:

1. A composition of lubricating oil for two stroke gasoline engine comprising (i) base stock of tailored heavy alkyl benzene having carbon atom mainly C21 to C25 in the range of 80-90% by weight of the lubricating oil, (ii) anti-oxidant in the range of 0.006-0.05% by weight of the lubricating oil
(iii) extreme pressure additive in the range of 0.01-0.05% by weight of the lubricating oil,
(iv) detergent-dispersant in the range of 0.05-0.15% by weight of the lubricating oil,
(v) anti-foaming agent in the range of 0.01 to 1.0% by weight of the lubricating oil,
(vi) pour point dispersant in the range of 0.01 to 1.0% by weight of the lubricating oil,
(vii) corrosion inhibitor in the range of 0.10-0.03% by weight of the lubricating oil
(viii) smoke reducing agent in the range 9.0-19.0% by weight of the lubricating oil,
(ix) optionally with lubricity additive in the range of 0.01-0.05% by weight of the lubricating oil, wherein said base stock has a kinematic viscosity at 40° C. in the range 40-60 cst and wherein said lubricating oil has biodegradability of not less than 40%, wherein the smoke reducing agent used is selected from the group consisting of neem oil, mahua oil, ricebran oil, acetylated castor oil, linseed oil, karanja oil, ethyl hexyl ester of neem oil fatty acid, ethyl hexyl ester of karanj oil fatty acid, ethyl hexyl ester of neem oil fatty acid, toluene derivative of vegetable oil/its mono-esters and a mixture thereof.

2. A composition of lubricating oil according to claim 1 has following characteristics:

(i) Kinetic viscosity at 100° C. is 6.5-8.5 cst,
(ii) Viscosity index 95-110,
(iii) Oxidation stability Pass (IP 49/97)
(iv) Rotatory bomb oxidation test (ROBOT) at 95° C. is 250-350 min.,
(v) Flash point 145-165° C.,
(vi) Pour point (−)20-30° C.,
(vii) Ash sulfated <0.05,
(viii) Performance-Smoke index 150-250,
(ix) Lubricity-Friction.Coeff. about 0.101,
(x) Wear Scarp Dia (WSD) about 0.533,
(xi) Detergency index 200-250,
(xii) Copper Strip corrosion test 1A,
(xiii) Foam test ASTM D130 Pass,
(xiv) Biodegradability 40-60%.

3. A composition according to claim 1, wherein the heavy alkyl benzene used is mono, di or poly substituted alkyl aromatics having one benzene aromatic ring and straight or branched paraffinic chains having carbon atoms 21 to 25.

4. A composition according to claim 1, wherein the heavy alkyl benzene fractions (C21-25) used is obtained from mono and di alkyl benzenes produced during the production of linear alkyl benzene (LAB) in detergent industry, heavy alkyl aromatics produced in catalytic reformer, and naphtha or gas steam cracker liquid product or mixture thereof.

5. A composition according to claim 1, wherein the antioxidant used is selected from the group consisting of 2,4,6-tri-tert-butylphenol, 2,6-di-tert-butyl-4-n-butylphenol, 2,6-di-t-butyl-4-methylphenol or n-octadecyl 3-(3,5-di-t-butyl-4-hydroxy phenyl) propionate, penta erythrityl tetrakis[3-(3,5-di-t-butyl-4-hydroxyphenyl) propionate], di-n-octadecyl (3,5-di-t-butyl-4-hydroxybenzyl)phosphonate, 2,4,6-tris(3,5-di-t-butyl-4-hydroxybenzyl) mesitylene, tris(3,5-di-t-butyl-4-hydroxybenzyl) isocyanurate or hindered piperidine carboxylic acids, acylated derivatives of 2,6-dihydroxy-9-azabicyclo[3.3.1]nonane or bicyclic hindered amines or diphenylamines or dinaphthylamines, phenylnaphthyl amines, N,N'-diphenylphenylenediamine or p-octyldiphenylamine, p,p-dioctyl diphenylamine, N-phenyl-1-naphthylamine, N-phenyl-2-naphthylamine, N-(p-dodecyl)phenyl-2-naphthylamine, di-1-naphthylamine, di-2naphthylamine, N-alkyl phenothiazines, imino(bisbenzyl), 6-(t-butyl)phenol, 2,6-di-(t-butyl)phenol, 4-methyl-2,6-di-(t-butyl)phenol, 4,4'-methylenebis(-2,6-di-(t-butyl)phenol), Methyl hydroxy hydro cinnamide, phenothiazines derivatives, alkylated 5-amino tetrazole, di-ter.Butyl p-amino phenol and a mixture thereof.

6. A composition according to claim 1, wherein the extreme pressure additive used is selected from the group consisting of sulfurized neem oil, sulfurized mahua oil, dibenzyl disulphide, suphurized pentadecyl phenol, thiophosphoro luryl oleate, molybdenum salt of thiophosphoro luryl oleate, zinc dialkyl dithio phosphate, dibenzyl diselenate, selenophosphoro luryl oleate, selenophosphoro pentadecyl phenol, molybdenum thiophosphoro pentadecyl phenol and a mixture thereof.

7. A composition according to claim 1, wherein the lubricity additive used is selected from octyl phosphates, methyl hydroxy hydro cinnamide and a mixture thereof.

8. A composition according to claim 1, wherein the detergent-dispersant used is selected from the group consisting of calcium alkyl benzene sulfonate, sodium alkyl benzene sulfonate, propylene teramer succinimide of pentaethylene hexamine, octyl phosphonates and a mixture thereof.

9. A composition according to claim 1, wherein the anti-foaming agent used is selected from the group consisting of silicone oil, polyvinyl alcohol, polyethers and a mixture thereof.

10. A composition according to claim 1, wherein the pour point dispersant used is selected from the group consisting of diethylhexyl adipate, polymethacrylate, polyvinylacrylate and a mixture thereof.

11. A composition according to claim 1, wherein the corrosion inhibitor used is selected from the group consisting of octyl 1H benzotriazole, ditertiary butylated 1H-Benzotriazole, propyl gallate, polyoxyalkylene polyols, octadecyl amines, nonyl phenol ethoxylates, calcium phenolates of hydrogenated pentadecyl phenol, magnesium alkyl benzene sulfonates and a mixture thereof.

12. A process for the preparation of composition of lubricating oil for two stroke gasoline engine, which comprises fractionating heavy alkylate fractions of linear alkyl benzene (LAB) or crackers, at a temperature in the range of 350-550° C., under vacuum distillation to obtain desired fractions of alkyl benzene having carbon atom C21 to C25 and viscosity in the range of 6-8 cst at about 100° C., removing the oxidized product from the above alkyl fractions by known methods to obtain a base stock, mixing 80-90 wt % of the above said base stock, at least one anti-oxidant in the range of 0.006-0.05 W %, at least one extreme pressure additive in the range of 0.01-0.05 W %, at least one detergent-dispersant in the range of 0.05-0.15 W %., at least one anti-foaming agent in the range of 0.01 to 1.0 W %, at least one pour point dispersant in the range of 0.01 to 1.0 W %, at least one corrosion inhibitor in the range of 0.10-0.03 W %, at least one smoke reducing agent in the range 9.0-19.0 W %, and optionally at least one lubricity additive in the range of 0.01-0.05 W %, under stirring, at a temperature in the range of 50-90° C. to obtain the desired lubricating oil composition, wherein the smoke reducing agent used is selected from the group consisting of neem oil, mahua oil, ricebran oil, acetylated castor oil, linseed oil, karanja oil, ethyl hexyl ester of neem oil fatty acid, ethyl hexyl ester of karanj oil fatty acid, ethyl hexyl ester of neem oil fatty acid, toluene derivative of vegetable oil/its monoesters and a mixture thereof.

13. A process according to claim 12 wherein the heavy alkyl benzene used is mono, di and poly substituted alkyl aromatics having one benzene aromatic ring and straight or branched paraffinic chains having carbon atoms mainly C21 to C25.

14. A process according to claim 12, wherein the heavy alkyl benzene fractions (C21-25) used is obtained from mono and di alkyl benzenes produced during the production of linear alkyl benzene (LAB) in detergent industry, heavy alkyl aromatics produced in catalytic reformer, and naphtha or gas steam cracker liquid product or mixture thereof.

15. A process according to claim 12, wherein the anti-oxidant used is selected from the group consisting of 2,4,6-tri-tert-butylphenol, 2,6-di-tert-butyl-4-n-butylphenol, 2,6-di-t-butyl-4-methylphenol or n-octadecyl 3-(3,5-di-t-butyl-4-hydroxy phenyl) propionate, penta erythrityl tetrakis[3-(3,5-di-t-butyl-4-hydroxyphenyl)propionate], di-n-octadecyl (3,5-di-t-butyl-4-hydroxybenzyl) phosphonate, 2,4,6-tris(3,5-di-t-butyl-4-hydroxybenzyl) mesitylene, tris(3,5-di-t-butyl-4-hydroxybenzyl) isocyanurate or hindered piperidine carboxylic acids, acylated derivatives of 2,6-dihydroxy-9-azabicyclo[3.3.1]nonane or bicyclic hindered amines or diphenylamines or dinaphthylamines, phenylnaphthyl amines, N,N'-diphenylphenylenediamine or p-octyldiphenylamine, p,p-dioctyl diphenylamine, N-phenyl-1-naphthylamine, N-phenyl-2-naphthylamine, N-(p-dodecyl)phenyl-2-naphthylamine, di-1-naphthylamine, di-2naphthylamine, N-alkyl phenothiazines, imino(bisbenzyl), 6-(t-butyl)phenol, 2,6-di-(t-butyl)phenol, 4-methyl-2,6-di-(t-butyl)phenol, 4,4'-methylenebis(-2,6-di-(t-butyl)phenol), Methyl hydroxy hydro cinnamide, phenothiazines derivatives, alkylated 5-amino tetrazole, di-ter.Butyl p-amino phenol and a mixture thereof.

16. A process according to claim 12, wherein the extreme pressure additive used is selected from the group consisting of sulfurized neem oil, sulfurized mahua oil, dibenzyl disulphide, suphurized pentadecyl phenol, thiophosphoro luryl oleate, molybdenum salt of thiophosphoro luryl oleate, zinc dialkyl dithio phosphate, dibenzyl diselenate, selenophosphoro luryl oleate, selenophosphoro pentadecyl phenol, molybdenum thiophosphoro pentadecyl phenol and a mixture thereof.

17. A process according to claim 12, wherein the lubricity additive used is selected from octyl phosphates, methyl hydroxy hydro cinnamide and a mixture thereof.

18. A process according to claim 12, wherein the detergent-dispersant used is selected from the group consisting of calcium alkyl benzene sulfonate, sodium alkyl benzene sulfonate, propylene teramer succinimide of pentaethylene hexamine, octyl phosphonates and a mixture thereof.

19. A process according to claim 12, wherein the anti-foaming agent used is selected from the group consisting of silicone oil, polyvinyl alcohol, polyethers and a mixture thereof.

20. A process according to claim 12, wherein the pour point dispersant used is selected from the group consisting of diethylhexyl adipate, polymethacrylate, polyvinylacrylate and a mixture thereof.

21. A process according to claim 12, wherein the corrosion inhibitor used is selected from the group consisting of octyl 1H benzotriazole, ditertiary butylated 1H-Benzotriazole, propyl gallate, polyoxyalkylene polyols, octadecyl amines, nonyl phenol ethoxylates, calcium phenolates of hydrogenated pentadecyl phenol, magnesium alkyl benzene sulfonates and a mixture thereof.

22. A process according to claim 12 wherein the lubricating oil composition obtained has the following characteristics:

(i) Kinetic viscosity at 40.degree. C. is in the range of 40-60 cst, (ii) Kinetic viscosity at 100.degree. C. is 6.5-8.5 cst, (iii) Viscosity index 95-110, (iv) Oxidation stability Pass (IP 48/97)

(v) Rotatory bomb oxidation test (ROBOT) at 95.degree. C. is 250-350 min., (vi) Flash point 145-165.degree. C., (vii) Pour point (−)20-30.degree. C., (viii) Ash sulfated <0.05,
(ix) Performance-Smoke index 150-250,
(x) Lubricity-Friction.Coeff. about 0.101,
(xi) Wear Scarp Dia (WSD) about 0.533,
(xii) Detergency index 200-250,
(xiii) Copper Strip corrosion test 1A,
(xiv) Foam test ASTM D130 Pass,
(xv) Biodegradability 40-60%.

* * * * *